US005939989A

United States Patent [19]

Bang

[11] Patent Number: 5,939,989

[45] Date of Patent: Aug. 17, 1999

[54] ELECTRONIC SWITCH UTILIZED IN, FOR EXAMPLE, A DROWSINESS WARNING DEVICE

[75] Inventor: Harry H. J. Bang, Pacific Palisades, Calif.

[73] Assignee: Richard M. Bang, Pacific Palisades, Calif.

[21] Appl. No.: 09/076,345

[22] Filed: May 12, 1998

[51] Int. Cl.[6] ..... G08B 23/00

[52] U.S. Cl. ..... 340/575; 340/576; 340/691; 200/538; 200/540; 200/541; 200/16 B

[58] Field of Search ..... 340/575, 576, 340/691, 665, 666, 667, 654, 687; 116/1, 28 R, 67 R, 137 R; 200/241, 246, 247, 252, 538, 540, 541, DIG. 2, 16 B, 16 E

[56] References Cited

U.S. PATENT DOCUMENTS

| | | | |
|---|---|---|---|
| 2,066,092 | 12/1936 | Brown | 116/67 R |
| 2,842,628 | 7/1958 | James | 340/575 |
| 3,340,846 | 9/1967 | Magiera | 116/67 R |
| 3,697,706 | 10/1972 | Huggard | 200/538 |
| 3,999,177 | 12/1976 | Greene | 340/576 |
| 4,272,764 | 6/1981 | Herr et al. | 340/575 |
| 5,264,672 | 11/1993 | Ishii et al. | 200/275 |
| 5,353,013 | 10/1994 | Estrada | 340/575 |
| 5,488,354 | 1/1996 | Colvin | 340/576 |
| 5,522,092 | 6/1996 | Streb et al. | 340/575 |
| 5,568,127 | 10/1996 | Bang | 340/575 |
| 5,581,239 | 12/1996 | Lin | 340/575 |
| 5,684,461 | 11/1997 | Jones | 340/575 |

*Primary Examiner*—Jeffery A. Hofsass
*Assistant Examiner*—Toan N. Pham
*Attorney, Agent, or Firm*—Kelly Bauersfeld Lowry & Kelley, LLP

[57] ABSTRACT

An electronic switch includes a rigid base, a circuit board supported by the base which includes an aperture therethrough defined, at least in part, by spaced apart conductive terminals of an electrically conductive circuit, a resiliently flexible casing attached to the base and overlying the circuit board, and a plunger attached to the casing and extending therefrom through the circuit board aperture. The plunger includes a conductive portion which is adjacent to the casing, and a non-conductive portion. The casing is resiliently biased so as to normally position the plunger such that the non-conductive portion thereof extends through the circuit board aperture. Depression of the casing, however, places the conductive portion within the aperture and into contact with the spaced apart conductive terminals to close the electrically conductive circuit. The electronic switch may be utilized in connection with, for example, a drowsiness warning device which includes a band securable about a wearer's neck. The electronic switch is positioned by the band below a wearer's chin for producing an alarm as the chin contacts and depresses the flexible casing so as to cause the electrically conductive circuit to close.

24 Claims, 4 Drawing Sheets

ELECTRONIC SWITCH UTILIZED IN, FOR EXAMPLE, A DROWSINESS WARNING DEVICE

BACKGROUND OF THE INVENTION

This invention relates generally to electronic switches. More specifically, the present invention relates to an electronic switch that may be utilized in, for example, a drowsiness warning device which provides a tactile and aural warning to a wearer as he or she becomes drowsy and the chin comes into contact with the electronic switch.

It is well known that many traffic accidents are caused by driver drowsiness and inattention to the road which occurs most frequently during long distance drives. The seriousness of the problems is emphasized by the number of people who lose their lives in such traffic accidents and the amount of property damage caused. To prevent oneself from falling asleep at the wheel, many drivers take stimulants to help them stay awake. The problem is particularly acute in the case of truck and bus drivers who routinely drive long distances.

One device previously devised that addresses the foregoing problems is shown in U.S. Pat. No. 5,568,127. There a drowsiness warning device and neck support is disclosed which includes a band which is securable about a wearer's neck, and an alarm positioned by the band below the wearer's chin for producing a tactile and an aural warning as the chin contacts the alarm device. The band includes a central section formed with a vertically stiff plastic material which is capable of holding a lower elongated body of the alarm therein. An upper rounded dome section of the alarm extends above the central section. The band also includes a pair of straps having hook and loop tape fasteners, and intermediate sections between the straps and the central section lined with a fibrous material for wearer comfort. In one of the disclosed embodiments, the alarm includes a hollow elastomeric ball having a mechanical noise maker disposed within an air inlet/outlet aperture for the ball. In another embodiment, the alarm includes an electrically actuated speaker which is connectable to a battery on depression of the upper rounded dome.

Although the device disclosed in U.S. Pat. No. 5,568,127 has satisfied a long-felt need for a suitable drowsiness warning device, there has remained a need for improved electrically actuated alarms/switches. In this regard, there has been a need for an electronic switch of more simplified construction which is yet highly reliable and suitable for use in a drowsiness warning device as disclosed in said patent. In addition to being of simplified construction, there has been a need for an electronic switch that can be assembled efficiently and yet is adaptable to a number of configurations for, possibly, a number of different uses. The electronic switch of the present invention fulfills these needs and provides other related advantages.

SUMMARY OF THE INVENTION

The present invention resides in an electronic switch that may be utilized in, for example, a drowsiness warning device. The electronic switch comprises, generally, a base, a circuit board supported by the base, a resiliently flexible casing which is attached to the base and overlies the circuit board, and a plunger which is attached to the casing and which extends therefrom through an aperture provided in the circuit board. The circuit board aperture is defined, at least in part, by spaced apart conductive terminals of an electrically conductive circuit. The plunger includes a conductive portion adjacent to the casing and a non-conductive portion. The casing normally positions the plunger such that the non-conductive portion of the plunger extends through the circuit board aperture. Depression of the casing, however, places the conductive portion of the plunger within the aperture and into contact with the spaced apart conductive terminals to close the electrically conductive circuit.

In one preferred form of the invention, the base is rigid in comparison with the resiliently flexible casing, and the base and the casing are attached to one another to cooperatively enclose the circuit board therein.

The base further includes a guide which slidingly receives the plunger, which guide includes a shoulder for limiting travel of the plunger therethrough.

The circuit board includes a battery to supply power to the electrically conductive circuit, and an audible alarm which is actuated when the electrically conductive circuit is closed. The audible alarm may be in the form of a sound chip, digital recorder, speaker, buzzer or vibrator. Such is particularly advantageous when the electronic switch is utilized as part of a drowsiness warning device. The circuit board may further include a light emitting diode which is also activated when the electrically conductive circuit is closed on depression of the casing and movement of the plunger through the circuit board aperture.

The plunger includes a shaft having, at one end, an enlarged head which is captured by a retaining flange of the casing to attach the plunger to the casing. The shaft is formed of an electrically non-conductive material. A conductive sleeve surrounds a portion of the shaft to form the conductive portion of the plunger. A portion of the shaft extending away from the sleeve opposite the enlarged head forms the non-conductive portion of the plunger. To facilitate proper operation of the plunger, the shaft includes a longitudinally extending channel.

When the electronic switch is utilized in a drowsiness warning device securable about a wearer's neck, the electronic switch is positioned by the band below a wearer's chin for producing an alarm as the chin contacts and depresses the flexible casing so as to cause the electrically conductive circuit to close. The band includes central means for holding the base of the electronic switch, and strap means at ends of the band for securing the band about the wearer's neck. The central holding means comprises a vertical wall having a pair of parallel, generally horizontally extending slots cut therein to define an upper front support segment, an intermediate rear support segment and a lower front support segment of the wall between which the rigid base is positioned. In one embodiment, the strap means includes hook and loop tape fasteners. In another embodiment, the strap means includes an adjustable draw string. In a third embodiment, the draw string may be configured to extend through a portion of the vertical wall.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
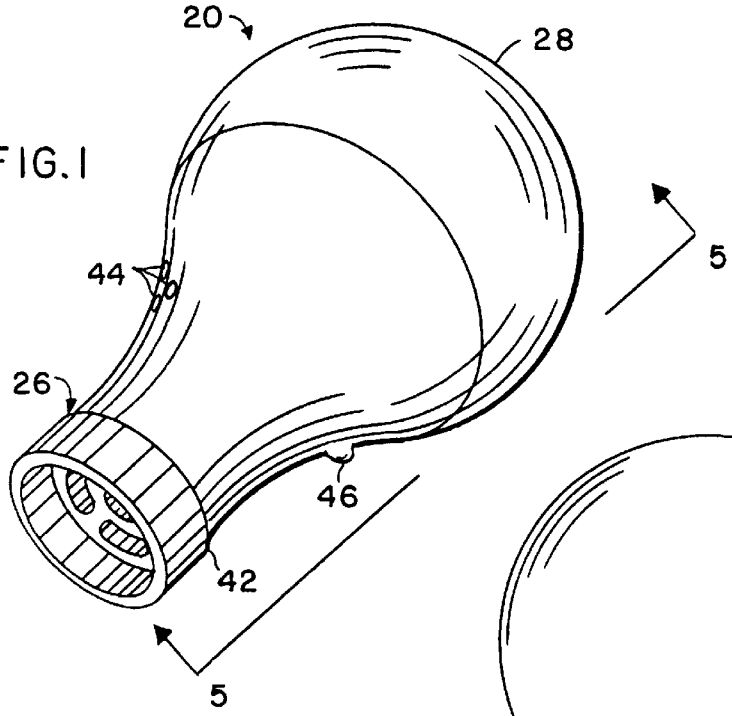
FIG. 1 is a side and bottom perspective view of an electronic switch embodying the invention.
Figure 2:
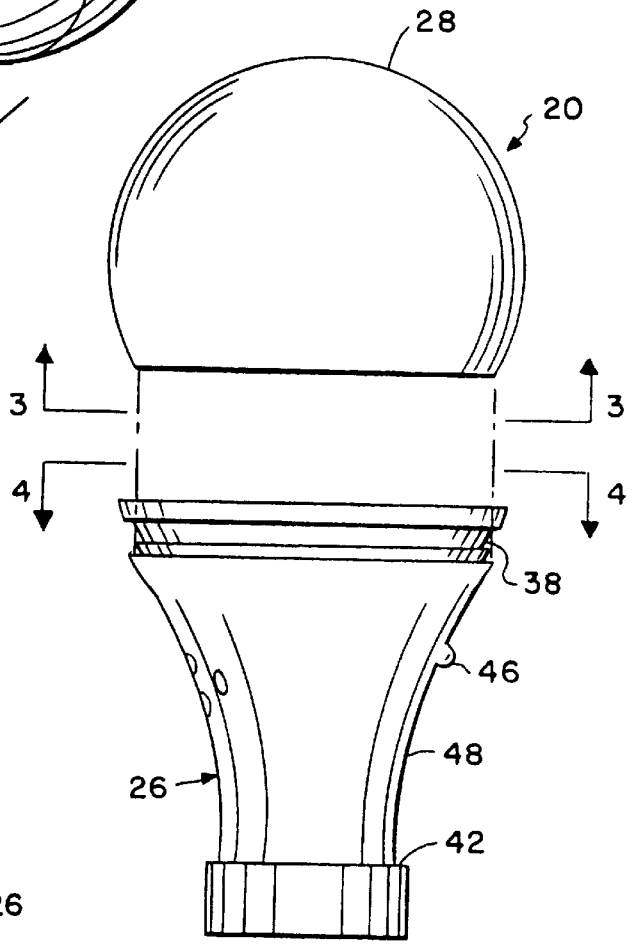
FIG. 2 is an exploded side elevational view of the electronic switch of FIG. 1, wherein an upper resiliently flexible casing is shown separated from a lower rigid base.
Figure 3:
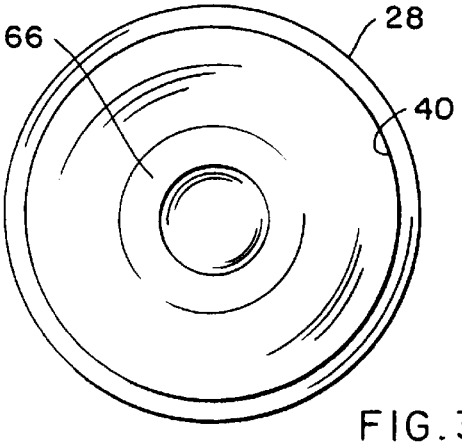
FIG. 3 is a bottom plan view of the upper resiliently flexible casing taken generally along the line 3—3 of FIG. 2.
Figure 4:
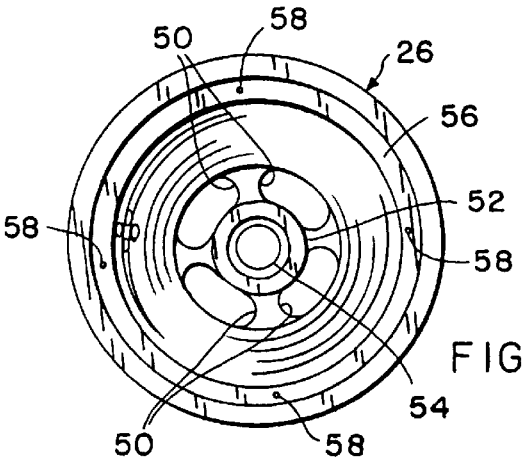
FIG. 4 is a top plan view of the lower rigid base taken generally along the line 4—4 of FIG. 1.

As shown in the drawings for purposes of illustration, the present invention is concerned with an electronic switch, generally designated in the accompanying drawings by the reference number 20. The electronic switch 20 is designed to be utilized in, for example, a drowsiness warning device and neck support 22—22". In this regard, the drowsiness warning devices 22—22" (FIGS. 8–11) comprise, generally, a neck band 24 which is securable about a wearer's neck, and the electronic switch 20 which functions as an alarm device and is positioned by the neck band 24 below the wearer's chin. The electronic switch 20 is capable of producing both a tactile and an aural warning as the chin contacts the electronic switch 20 when the wearer's head droops. A similar device is shown in U.S. Pat. No. 5,568,127, the contents of which are incorporated herein.

In accordance with the present invention and with reference initially to FIGS. 1–7, the electronic switch 20 includes a lower rigid base 26 and an upper resiliently flexible casing 28 which cooperatively define an enclosure for a circuit board 30 and a plunger 32. The circuit board 30 is in the nature of a printed circuit board and includes an aperture 34 that is defined, at least in part, by spaced apart conductive terminals 36 of an electrically conductive circuit provided by the circuit board 30. The plunger 32 is attached to the casing 28 and extends therefrom through the circuit board aperture 34. It is the slidable movement of the plunger 32 through the aperture 34 that opens and closes the electrically conductive circuit of the circuit board 30 by moving a conductor into and out of contact with the conductive terminals 36.

More particularly, the base 26 is generally frusto-conical and has an upper circumscribing groove 38 that receives a lower base-engaging ring 40 provided in a lower end of the casing 28. A lower end of the base 26 is formed to include a shoulder 42 to helps retain the electrical switch 20 within the neck band 24. Intermediate the upper circumscribing groove 38 and the lower shoulder 42 are a plurality of apertures 44 that enhance transmission of sound generated within the electronic switch 20. A locking nib 46 further protrudes exteriorly from a wall 48 of the base 26 to help lock the electronic switch 20 within the neck band 24.

The portion of the base 26 adjacent to the lower shoulder 42 surrounds a plurality of lower apertures 50 that also permit greater transmission of sounds generated within electronic switch 20 when actuation thereof activates an audible alarm. A rigid plunger guide 52 extends centrally upwardly within the base 26 and is configured to receive a lower end of the plunger 32 therein. The plunger guide 52 includes a lower stop shoulder 54 which limits the extent of travel of the plunger therethrough. Adjacent to an upper end of the base 26, a circuit board retaining shoulder 56 is provided. Several guide pins 58 extend upwardly from the retaining shoulder 56 and are received within corresponding positioning apertures 60 provided in the circuit board 30. The retaining shoulder 56 and the guide pins 58 cooperatively retain the circuit board 30 in place within the base 26 without the need for an adhesive or the like.

Figure 5:
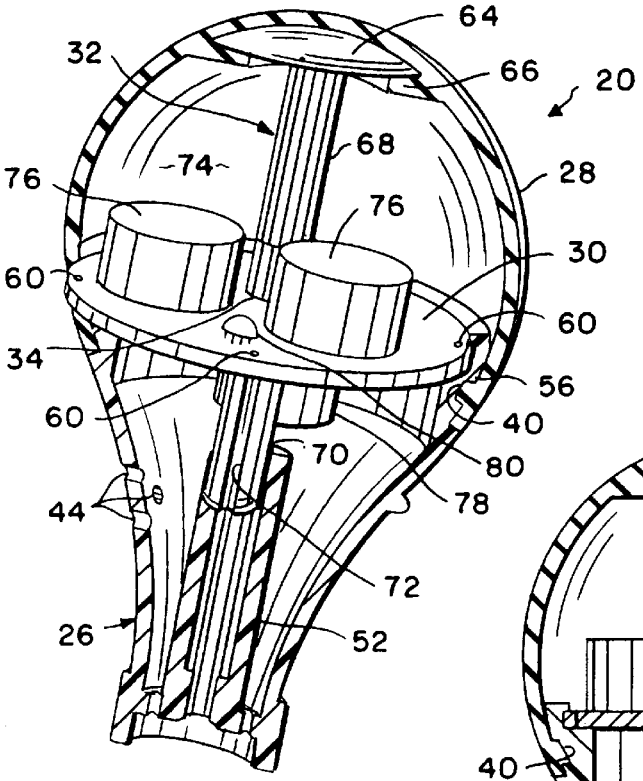
FIG. 5 is a sectional view of the electronic switch taken generally along the line 5—5 of FIG. 1, illustrating, in a somewhat exploded perspective view, internal components of the electronic switch.
Figure 11:
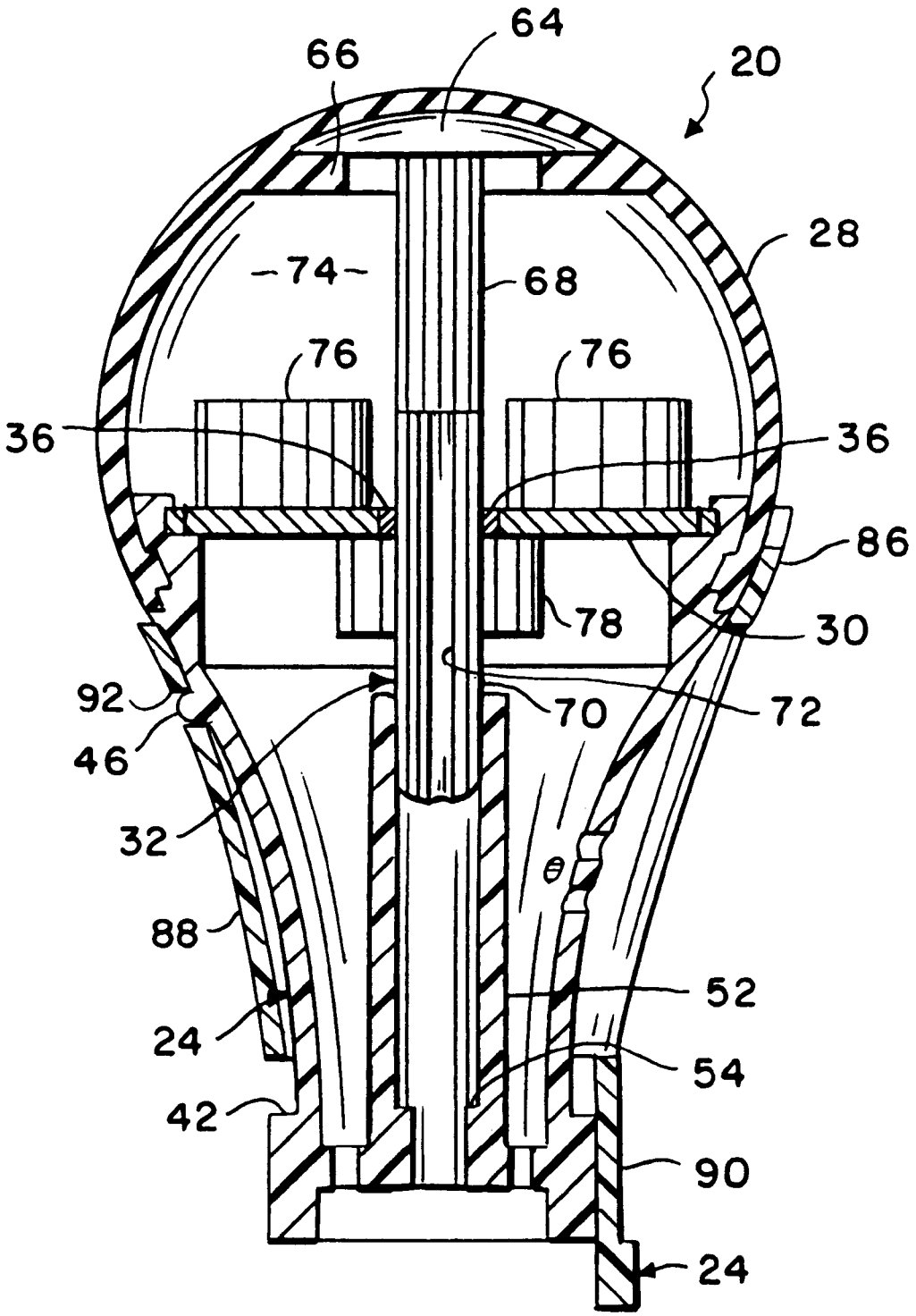
FIG. 11 is an enlarged sectional view of the electronic switch secured in place to a neck support, taken generally along the line 11—11 of FIG. 8.

The plunger 32 includes a conductive portion adjacent to the casing 28 and a non-conductive portion. The casing 28 normally positions the plunger 32 such that the nonconductive portion extends through the circuit board aperture 34, but depression of the casing places the conductive portion within the aperture and into contact with the spaced apart conductive terminals 36 to close the electrically conductive circuit. More particularly, the plunger includes a shaft 62 having, at one end, an enlarged head 64. The head 64 is captured by a retaining flange 66 of the casing 28 to attach the plunger 32 to the casing. Preferably, the plunger 32 is molded of an electrically nonconductive material, and a conductive sleeve 68 surrounds a portion of the shaft adjacent to the head 64 to form the conductive portion of the plunger 32. The portion 70 of the shaft 62 which extends away from the sleeve 68 opposite the head 64 forms the non-conductive portion of the plunger. As best shown in FIGS. 5 and 11, the shaft 32 includes a longitudinally extending channel 72 which permits air flow into and out of the chamber 74 between the circuit board 30 and the casing 28.

The circuit board 30 includes a pair of batteries 76 conductively coupled to and forming a portion of the electrically conductive circuit, an audible alarm 78, and a light emitting diode 80, both of which are actuated when the electrically conductive circuit is closed. Of course, the positioning and the various components of the electrically conductive circuit on the circuit board 30 may be varied by one of skill in the art. For example, if the casing 28 is formed of a transparent or translucent material, then the light emitting diode 80 would be placed on an upper surface of the circuit board 30. Alternatively, if the base 26 where formed of a transparent or translucent material, then it may be preferable to place the light emitting diode 80 on a lower surface of the circuit board 30.

Figure 6:
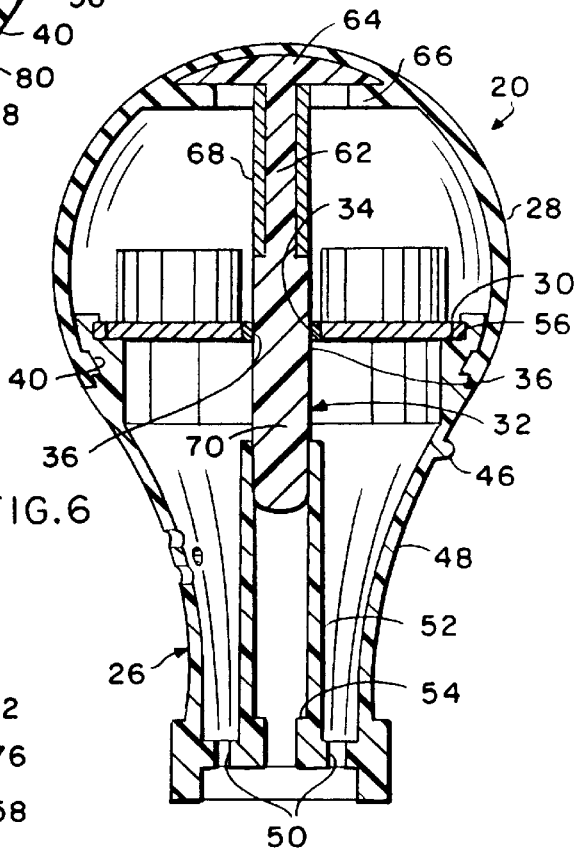
FIG. 6 is a vertical sectional view of the assembled electronic switch taken generally along the line 5–5 of FIG. 1, wherein an electrically conductive circuit associated with a circuit board is opened due to placement of a non-conductive portion of a plunger between a pair of spaced apart conductive terminals.
Figure 7:
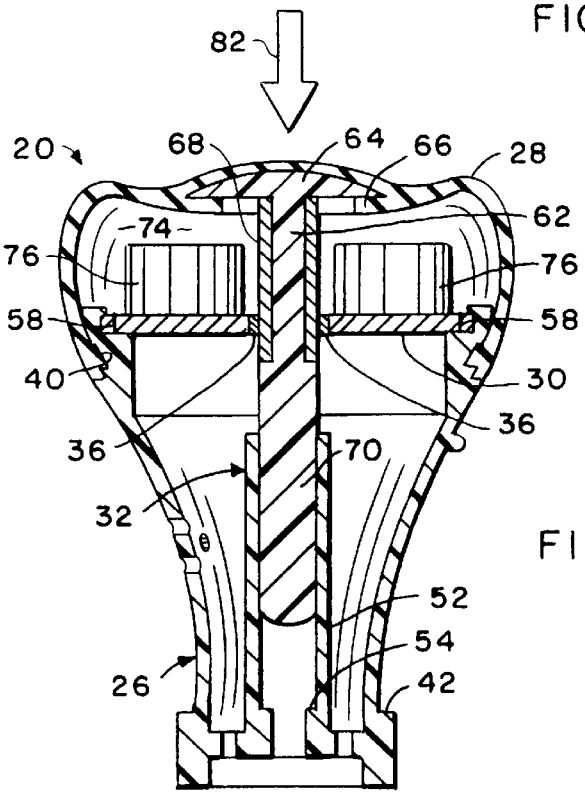
FIG. 7 is an elevational sectional view similar to that shown in FIG. 6, illustrating depression of the casing to place a conductive portion of the plunger within an aperture of the circuit board and into contact with the spaced apart conductive terminals to close the electrically conductive circuit.

Under normal operating conditions, the casing 28 is biased so as to hold the plunger 32 as illustrated in FIG. 6 so that the non-conductive portion 70 extends through the aperture 34 defined, at least in part, by the conductive terminals 36. Since the conductive terminals 36 form a break in the electrically conductive circuit, the circuit is open in this configuration and the actuable components, such as the audible alarm 78 (which may be a sound chip, digital recorder, speaker, buzzer or vibrator) and the light emitting diode 80 will not be actuated. However, upon depressing the upper surface of the casing 28 as illustrated by arrow 82 in FIG. 7, the lower end of the shaft 62 slides downwardly within the plunger guide 52 until the conductive sleeve 68 is disposed between the conductive terminals 36 thereby completing (closing) the electrically conductive circuit. As mentioned previously, the stop shoulder 54 limits travel of the shaft 62 within the plunger guide 52 to protect the electronic components of the circuit board 30. Next, as the downward force illustrated by the arrow 82 in FIG. 7 is removed, the casing 28 will resiliently return to its original configuration, thus removing the conductive sleeve 68 from contact with the conductive terminals 36 and again opening the electrically conductive circuit, or turning the switch "off".

With reference now to FIGS. 8–11, the electronic switch 20 may be advantageously utilized with the drowsiness warning device and neck supports 22—22". As mentioned previously, the drowsiness warning devices 22—22" comprise, generally, a neck band 24 and an alarm device which is provided by the electronic switch 20. The electronic switch 20 is capable of producing both a tactile and an aural warning as the chin of a wearer contacts the electronic switch 20, and specifically the upper end of the casing 28, when the wearer's head droops. When the electronic switch 20 is utilized as an alarm in a drowsiness warning device 22—22", it is securely positioned within the neck band 24 such that the casing 28 provides an upper rounded dome which extends above an upper edge of the neck band 24 and which is positioned immediately below the chin of the wearer. The base 26 is configured to be held securely within a central section 84 of the neck band 34.

Figure 8:
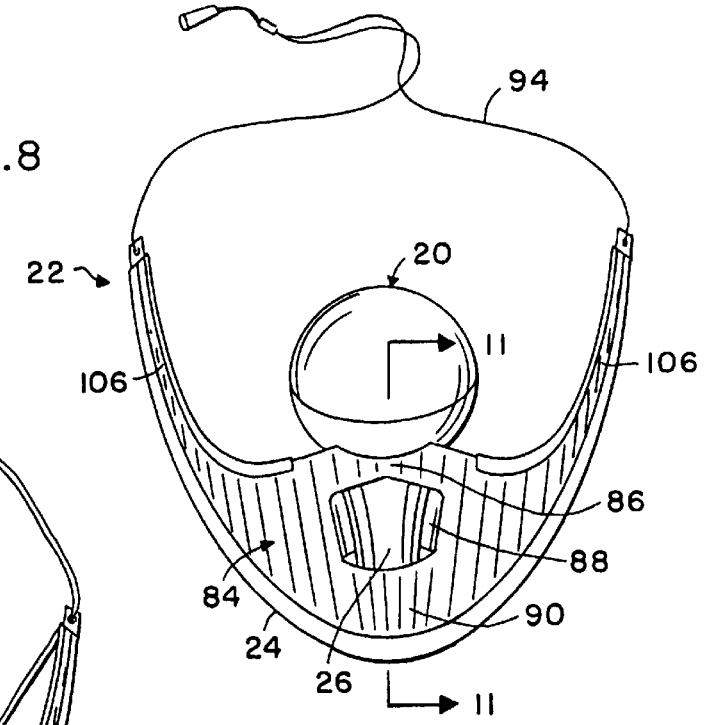
FIG. 8 is a perspective view of one preferred form of a drowsiness warning device in accordance with the invention utilizing the electronic switch of FIGS. 1–7.
Figure 9:
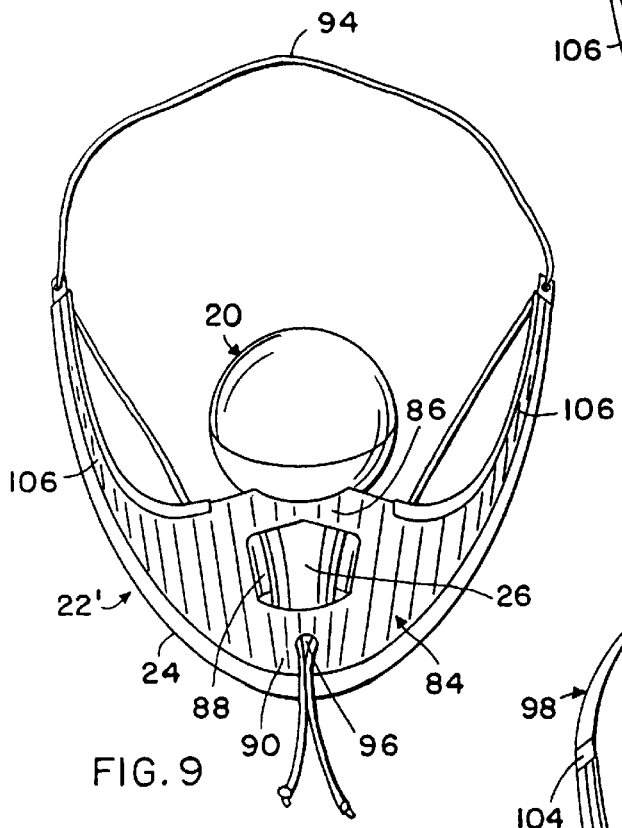
FIG. 9 illustrates a second embodiment of a drowsiness warning device embodying the invention and utilizing the electronic switch of FIGS. 1–7.
Figure 10:
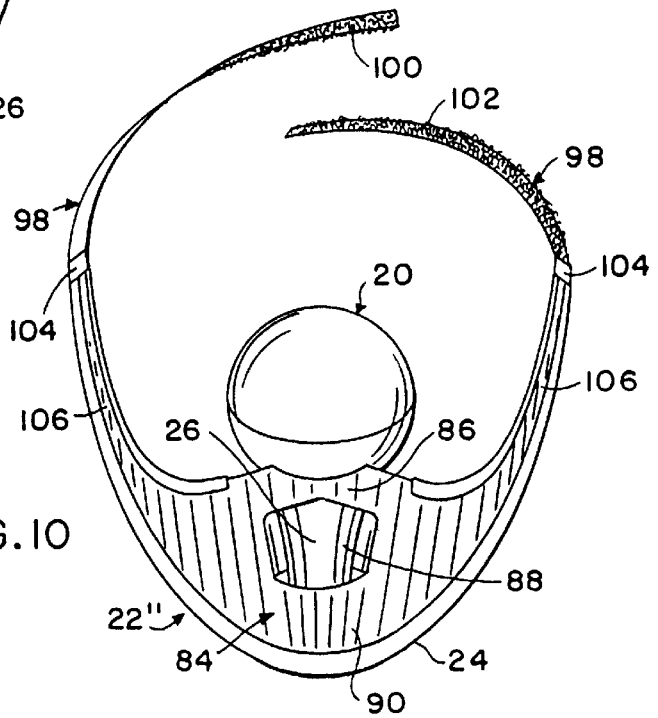
FIG. 10 illustrates a third embodiment of a drowsiness warning device embodying the invention and utilizing the electronic switch of FIGS. 1–7.

The central section 84 of the neck band 24 comprises a vertical wall having a pair of parallel, generally horizontally extending slots which are cut therein to define an upper front support segment 86, an intermediate rear support segment 88, and a lower front support segment 90 between which the base 26 of the electronic switch 20 is positioned. The intermediate rear support segment includes an aperture 92 therein configured to receive the locking nib 46 to assist in holding the electronic switch 20 securely within the neck band 24. In one embodiment, an adjustable draw string 94 is attached to the ends of the neck band 24 so as to secure the drowsiness warning device 22 to the wearer (FIG. 8). In another embodiment (FIG. 9) the draw string 94 slides through the ends of the neck band 24 and extends forwardly through a string tie aperture 96 provided in the lower support segment 90 of the central section 84. In a third embodiment (FIG. 10) a pair of straps 98 define opposite ends of the neck band 24. The straps include hook tape 100 and loop tape 102 fasteners which engage each other in a known manner to secure the straps 98 to one another. The straps 98 are connected, utilizing strap anchors 104, to intermediate sections of the neck band 24 which extend between the central section 84 and the straps 98. These intermediate sections 106, which are found in each of the three embodiments of the drowsiness warning devices 22—22", include a vertically stiff, exteriorly facing support member, a fibrous interiorly facing lining adjacent to the support member, and upper and lower edge guards extending over, respectively, upper and lower edges of the support member and adjacent lining.

As noted above, the drowsiness warning devices 22—22" are constructed to position the upper portion of the casing 28 of the electronic switch 20 immediately below the chin of the wearer. As the wearer becomes drowsy, the head naturally droops thus causing the chin to engage the casing 28. Such engagement provides a tactile warning that the person is becoming drowsy. Upon depression of the casing 28, the plunger 32 is forced downwardly to bring the conductive sleeve 68 into contact with the conductive terminals 36 to close the electrically conductive circuit and actuate the alarm elements of the circuit.

From the foregoing it will be appreciated that the drowsiness warning devices 22—22" provides improved apparatus for alerting a wearer when his or her head begins to droop due to drowsiness. In addition to drivers, the devices 22—22" may be advantageously utilized by others who are subject to becoming drowsy, such as night watchmen. The devices are manufactured of relatively simple components and is quite easy to use. Moreover, the electronic switch 20 of the present invention provides a novel actuating mechanism that may be adapted to many other uses in addition to the drowsiness warning devices illustrated herein.

Although several embodiments of the invention have been described in detail for purposes of illustration, various modifications may be made without departing from the spirit and scope of the invention. Accordingly, the invention is not to be limited, except as by the appended claims.

I claim:

1. An electronic switch, comprising:

a rigid base;

a circuit board supported by the base and including an aperture therethrough defined, at least in part, by spaced apart conductive terminals of an electrically conductive circuit;

a resiliently flexible casing attached to the base and overlying the circuit board; and a plunger attached to the casing and extending therefrom through the circuit board aperture, the plunger including a conductive portion adjacent to the casing and a non-conductive portion, wherein the casing normally positions the plunger such that the non-conductive portion extends through the circuit board aperture, but depression of the casing places the conductive portion within the aperture and into contact with the spaced apart conductive terminals to close the electrically conductive circuit.

2. The electronic switch of claim 1, wherein the base and the casing cooperatively enclose the circuit board.

3. The electronic switch of claim 1, wherein the base includes a guide attached at a lower end and extending upwardly within the base that slidingly receives the plunger therein.

4. The electronic switch of claim 3, wherein the plunger guide includes a shoulder for limiting downward travel of the plunger therethrough.

5. The electronic switch of claim 1, wherein the plunger includes a shaft having, at one end, an enlarged head which is captured by a retaining flange of the casing to attach the plunger to the casing.

6. The electronic switch of claim 5, wherein the shaft is formed of an electrically non-conductive material, wherein a conductive sleeve surrounds a portion of the shaft to form the conductive portion of the plunger, and wherein a portion of the shaft extending away from the sleeve opposite the enlarged head forms the non-conductive portion of the plunger.

7. The electronic switch of claim 5, wherein the shaft includes a longitudinally extending channel.

8. The electronic switch of claim 1, wherein the circuit board includes a battery and an audible alarm actuated when the electrically conductive circuit is closed.

9. The electronic switch of claim 1, wherein the circuit board includes a battery and visible indicia actuated when the electrically conductive circuit is closed.

10. The electronic switch of claim 9, wherein the visible indicia comprises a light emitting diode.

11. The electronic switch of claim 1 utilized in a drowsiness warning device including a band securable about a wearer's neck, wherein the electronic switch is positioned by the band below a wearer's chin for producing an alarm as the chin contacts and depresses the flexible casing so as to cause the electrically conductive circuit to close.

12. The electronic switch of claim 11, wherein the band includes central means for holding the base of the electronic switch, and strap means at ends of the band for securing the band about the wearer's neck.

13. The electronic switch of claim 12, wherein the strap means includes hook and loop tape fasteners.

14. The electronic switch of claim 12, wherein the strap means includes an adjustable draw string.

15. The electronic switch of claim 14, wherein the centralholding means comprises a vertical wall having a pair of parallel, generally horizontally extending slots cut therein to define an upper front support segment, an intermediate rear support segment and a lower front support segment of the wall between which the rigid base is positioned.

16. The electronic switch of claim 15, wherein the draw string extends through a portion of the vertical wall.

17. An electronic switch, comprising:

a base;

a circuit board supported by the base and including an aperture therethrough defined, at least in part, by spaced apart conductive terminals of an electrically conductive circuit, the circuit board further including a battery and an audible alarm actuated when the electrically conductive circuit is closed;

a resiliently flexible casing attached to the base and overlying the circuit board, wherein the base and the casing cooperatively enclose the circuit board; and a plunger attached to the casing and extending therefrom through the circuit board aperture, the plunger including a conductive portion adjacent to the casing and a non-conductive portion, wherein the casing normally positions the plunger such that the non-conductive portion extends through the circuit board aperture, but depression of the casing places the conductive portion within the aperture and into contact with the spaced apart conductive terminals to close the electrically conductive circuit, the plunger further including a shaft having, at one end, an enlarged head which is captured by a retaining flange of the casing to attach the plunger to the casing.

18. The electronic switch of claim 17, wherein the base includes a guide that slidingly receives the plunger therein, the guide including a shoulder for limiting travel of the plunger therethrough.

19. The electronic switch of claim 17, wherein the shaft is formed of an electrically non-conductive material, wherein a conductive sleeve surrounds a portion of the shaft to form the conductive portion of the plunger, and wherein a portion of the shaft extending away from the sleeve opposite the enlarged head forms the non-conductive portion of the plunger.

20. The electronic switch of claim 19, wherein the shaft includes a longitudinally extending channel.

21. The electronic switch of claim 17, wherein the circuit board further includes a light emitting diode that is actuated when the electrically conductive circuit is closed.

22. The electronic switch of claim 17 utilized in a drowsiness warning device including a band securable about a wearer's neck, wherein the electronic switch is positioned by the band below a wearer's chin for producing an alarm as the chin contacts and depresses the flexible casing so as to cause the electrically conductive circuit to close.

23. An electronic switch utilized in a drowsiness warning device securable about a wearer's neck, comprising:

a rigid base;

a circuit board supported by the base and including an aperture therethrough defined, at least in part, by spaced apart conductive terminals of an electrically conductive circuit, the circuit board further including a battery, an audible alarm actuated when the electrically conductive circuit is closed, and a light emitting diode also actuated when the electrically conductive circuit is closed;

a resiliently flexible casing attached to the base and overlying the circuit board, wherein the base and the casing cooperatively enclose the circuit board; and a plunger attached to the casing and extending therefrom through the circuit board aperture, the plunger including a conductive portion adjacent to the casing and a non-conductive portion, wherein the casing normally positions the plunger such that the non-conductive portion extends through the circuit board aperture, but depression of the casing places the conductive portion within the aperture and into contact with the spaced apart conductive terminals to close the electrically conductive circuit, the plunger further including a shaft having, at one end, an enlarged head which is captured by a retaining flange of the casing to attach the plunger to the casing;

wherein the shaft is formed of an electrically non-conductive material, a conductive sleeve surrounding a portion of the shaft forms the conductive portion of the plunger, a portion of the shaft extending away from the sleeve opposite the enlarged head forms the non-conductive portion of the plunger, the shaft includes a longitudinally extending channel, and wherein the electronic switch is positioned by the band below a wearer's chin for producing an alarm as the chin contacts and depresses the flexible casing so as to cause the electrically conductive circuit to close.

24. The electronic switch of claim 23, wherein the base includes a guide that slidingly receives the plunger therein, the guide including a shoulder for limiting travel of the plunger therethrough.

* * * * *